US010290966B2

(12) United States Patent
Washio et al.

(10) Patent No.: US 10,290,966 B2
(45) Date of Patent: May 14, 2019

(54) JOINT CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/565,443

(22) PCT Filed: Apr. 8, 2016

(86) PCT No.: PCT/JP2016/061468
§ 371 (c)(1),
(2) Date: Oct. 10, 2017

(87) PCT Pub. No.: WO2016/175010
PCT Pub. Date: Nov. 3, 2016

(65) Prior Publication Data

US 2018/0131117 A1 May 10, 2018

(30) Foreign Application Priority Data

Apr. 28, 2015 (JP) ..... 2015-091258

(51) Int. Cl.
*H01R 24/00* (2011.01)
*H01R 13/42* (2011.01)
(Continued)

(52) U.S. Cl.
CPC ..... *H01R 13/42* (2013.01); *H01R 13/631* (2013.01); *H01R 13/6315* (2013.01); *H01R 31/08* (2013.01)

(58) Field of Classification Search
CPC ..... H01R 2103/00; H01R 13/7032; H01R 13/703; H01R 13/7033; H01R 24/46; H01R 24/60; H01R 23/688; H01R 23/6873
(Continued)

(56) References Cited

U.S. PATENT DOCUMENTS 6,783,396 B1 * 8/2004 Osterhart ..... H01R 13/521 439/587
6,786,747 B1 * 9/2004 Kamath ..... H01R 13/6273 439/188
(Continued)

FOREIGN PATENT DOCUMENTS

JP 2014-49399 3/2014
JP 2014-225469 12/2014

OTHER PUBLICATIONS

International Search Report dated Jun. 7, 2016.

*Primary Examiner* — Hien D Vu
(74) *Attorney, Agent, or Firm* — Gerald E. Hespos; Michael J. Porco; Matthew T. Hespos

(57) ABSTRACT

A joint connector is provided which can suppress the abrasion of contact parts due to relative displacements between wire-side terminals and a shorting member. The joint connector includes a plurality of wire-side terminals (20), a shorting member (30) including a base portion (32) and a plurality of terminal fitting portions (34), and an insulating housing (HG) defining a plurality of terminal accommodating chambers (41) and configured to hold the shorting member (30). The insulating housing (HG) includes a terminal holding housing portion (40) defining the terminal
(Continued)

accommodating chambers (41) and configured to respectively lock the wire-side terminals (20) and a shorting member holding housing portion (50) configured to hold the shorting member (30). The both housing portions (40, 50) are so connected while restraining each other as to allow relative displacements between the both within a limited range.

15 Claims, 13 Drawing Sheets

(51) Int. Cl.
*H01R 13/631* (2006.01)
*H01R 31/08* (2006.01)

(58) Field of Classification Search
USPC ..... 439/660, 188, 108
See application file for complete search history.

(56) References Cited

U.S. PATENT DOCUMENTS 7,402,057 B1 * 7/2008 Strang ..... H01R 13/7032
439/188
9,666,972 B2 * 5/2017 Martin ..... H01R 9/24

* cited by examiner

JOINT CONNECTOR

BACKGROUND

Field of the Invention

The invention relates to a method for forming a short circuit for electrically shorting a plurality of wires included in a wiring harness of an automotive vehicle and a joint connector for forming this short circuit.

Description of the Related Art

Japanese Unexamined Patent Publication No. 2014-049399 discloses a joint connector for shorting wires in a wiring harness of an automotive vehicle. This joint connector includes female terminal fittings, i.e. wire-side terminals mounted on respective wires to be shorted to each other. This joint connector also has an insulating housing with terminal accommodating chambers for receiving the respective wire-side terminals and terminal locking portions for locking the respective wire-side terminals inserted into the terminal accommodating chambers. A shorting member (busbar in Japanese Unexamined Patent Publication No. 2014-049399) is provided in the insulating housing.

The busbar is formed of a conductor, specifically a metal plate, and integrally includes a base portion (coupling portion) and terminal fitting portions (male terminals) projecting form this base portion (coupling portion) The respective terminal fitting portions are shaped to fit to the wire-side terminals to be inserted into the respective terminal accommodating chambers. The base portion of this shorting member allows electrical conduction between the plurality of wire-side terminals fit to the respective terminal fitting portions, thereby forming a short circuit for shorting the wires.

However, in the joint connector described in Japanese Unexamined Patent Publication No. 2014-049399, the respective wire-side terminals easily are displaced relative to the shorting member and the abrasion of contact parts between the shorting member and the wire-side terminals may be promoted by these relative displacements. Specifically, since the wire-side terminal is locked merely by being engaged with a locking lance or the like in the insulating housing, a relative displacement is possible within a tiny range with respect to the insulating housing due to the vibration of the wire or the like. On the other hand, since the shorting member is fixed relatively firmly in the insulating housing to resist against attachment/detachment forces of the wire-side terminal to and from the shorting member, a relative displacement of the wire-side terminal with respect to the insulating housing is related directly to a relative displacement with respect to the shorting member.

The present invention aims to provide a joint connector including wire-side terminals to be respectively mounted on a plurality of wires and a shorting member configured to contact these wire-side terminals, and capable of suppressing the abrasion of contact parts due to relative displacements between the wire-side terminals and the shorting member.

SUMMARY

The present invention is directed to a joint connector for forming a short circuit for shorting a plurality of wires. The joint connector includes wire-side terminals to be mounted on ends of the respective wires, a shorting member formed of a conductor and including a base portion extending in a specific direction and terminal fitting portions projecting in the same direction from the base portion. Each terminal fitting portion is shaped to fit to each wire-side terminal. The joint connector also has an insulating housing defining terminal accommodating chambers enabling the wire-side terminals to be inserted therein along an axial direction of the wire-side terminals and configured to hold the shorting member so that the wire-side terminal inserted into each terminal accommodating chamber is fit to the terminal fitting portion. The insulating housing includes a terminal holding housing portion defining the terminal accommodating chambers and including terminal locking portions configured to lock the respective wire-side terminals inserted into the terminal accommodating chambers, and a shorting member holding housing portion that is a member independent of the terminal holding housing portion and is configured to hold the shorting member at a position where the shorting member is spaced from the terminal holding housing portion. The terminal holding housing portion and the shorting member holding housing portion are connected while restraining each other to allow a relative displacement of the shorting member holding housing portion with respect to the terminal holding housing portion within a limited range.

DETAILED DESCRIPTION

Figure 1:
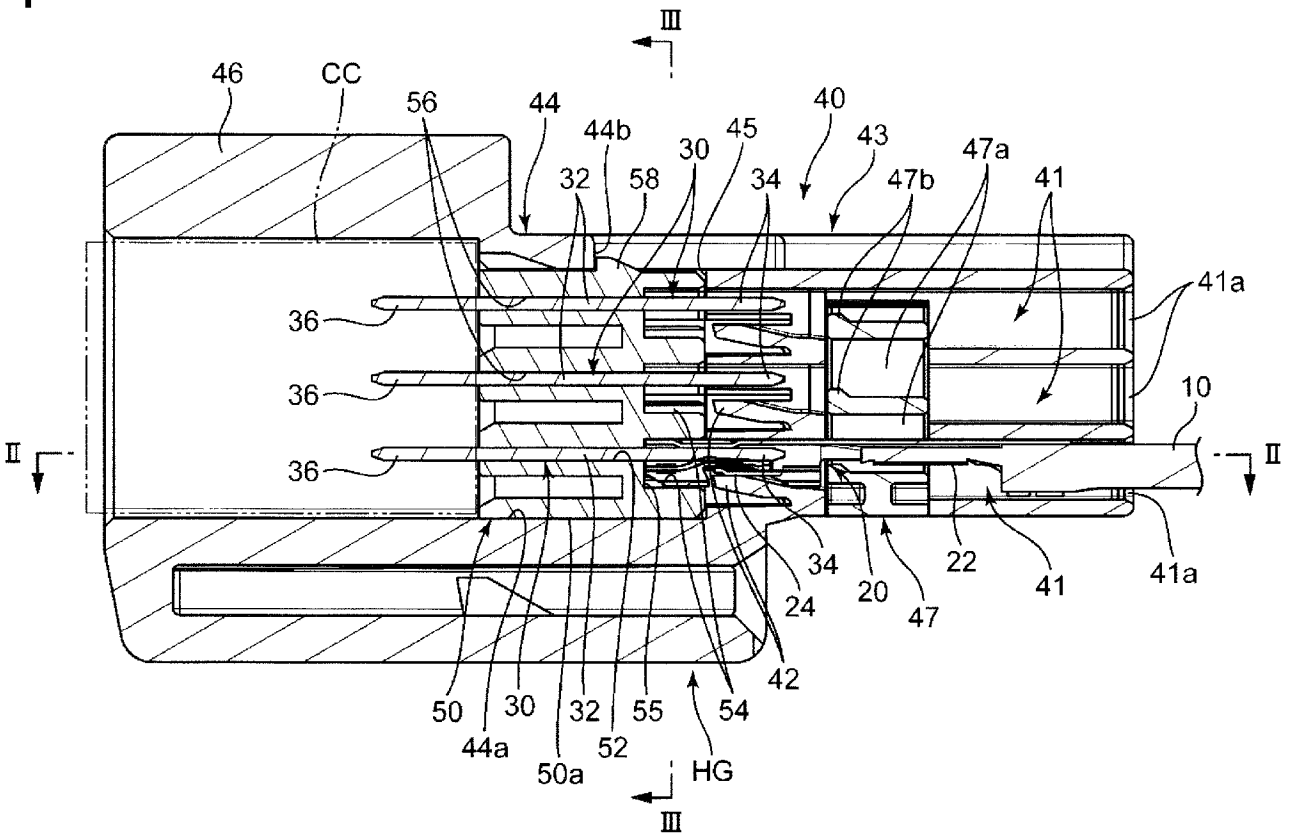
FIG. 1 is a side view in section along I-I of FIG. 5 of a joint connector according to a first embodiment of the present invention.
Figure 2:
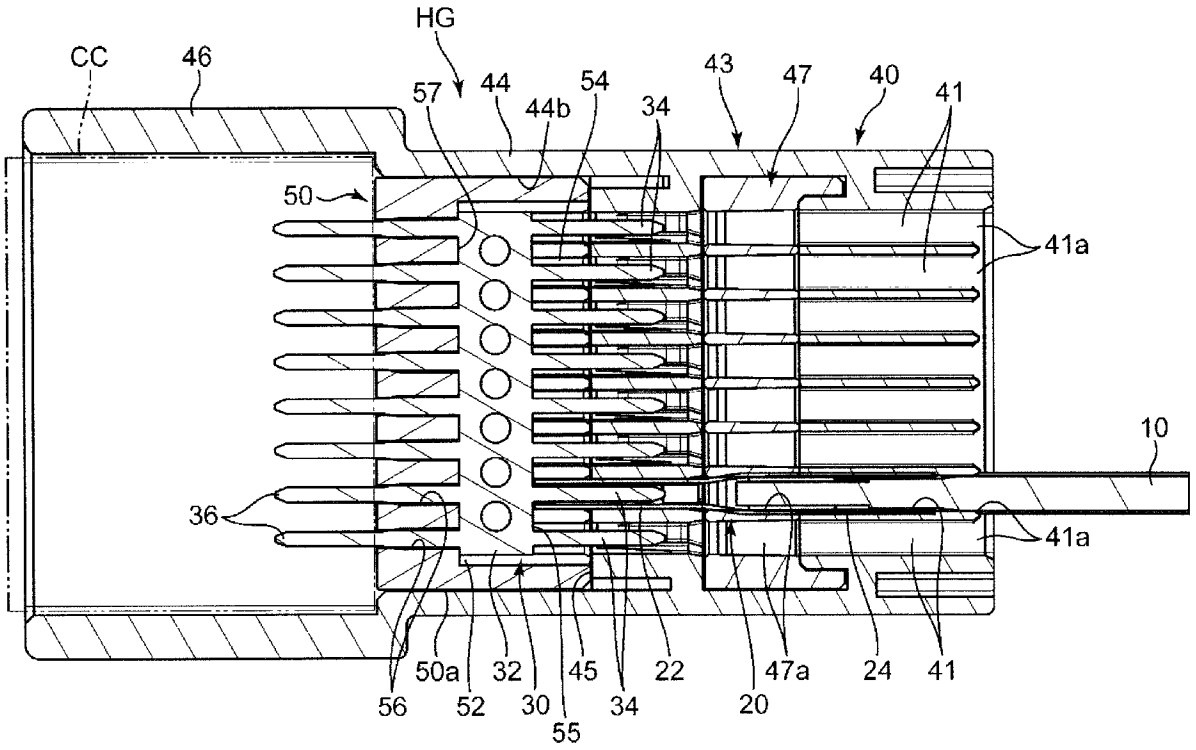
FIG. 2 is a plan view in section along II-II of FIG. 1.
Figure 3:
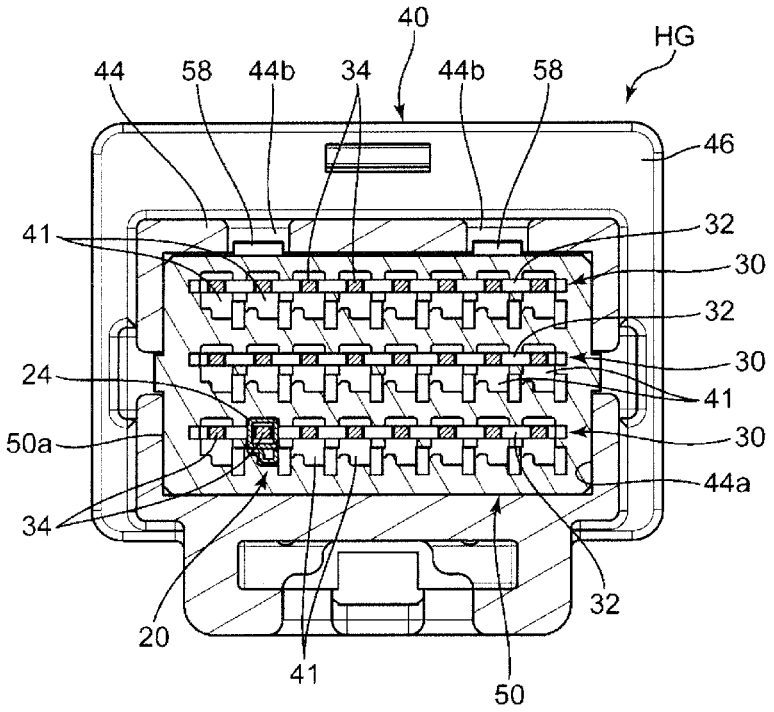
FIG. 3 is a front view in section along III-Ill of FIG. 1.

Embodiments of the present invention are described with reference to the drawings.

FIGS. 1 to 8 show a joint connector according to a first embodiment of the present invention. This joint connector is a connector for shorting a plurality of wires 10 to each other and includes wire-side terminals 20, shorting members 30 and an insulating housing HG.

The wire-side terminals 20 are mounted respectively on ends of the wires 10. Each wire-side terminal 20 according to this embodiment is a so-called female terminal and includes a wire crimping portion 22 and an electrical contact portion 24, and these portions 22, 24 are formed from a single metal plate. The wire crimping portion 22 is a part to be crimped to the end of the wire 10, and electrical conduction between the wire-side terminal and a conductor part of the wire 10 is enabled by this crimping. The electrical contact portion 24 is a part configured to electrically contact the shorting member 30, i.e. contact the shorting member 30 to form electrical conduction by being fit to the shorting member 30. The electrical contact portion 24 in this embodiment is of a female type and receives the shorting member 30 fit therein Each of the shorting members 30 is formed of a conductor and integrally includes a base portion 32, a plurality of terminal fitting portions 34 and plural connector terminal portions 36. Each shorting member 30 according to this embodiment is formed of a single flat metal plate.

The base portion 32 is shaped to extend in a specific direction while having a fixed width. The terminal fitting portions 34 are arranged at intervals in the specific direction and project in a first projecting direction perpendicular to the specific direction. Each terminal fitting portion 34 is fit, as a so-called male terminal (tab), into the female electrical contact portion 24, thereby being able to electrically contact the electrical contact portion 24. The connector terminal portions 36 are arranged at intervals in the specific direction and project from the base portion 32 in a second projecting direction opposite to the first projecting direction, thereby constituting terminals of a joint connector different from (located on a side opposite to) the joint connector constituted by the terminal fitting portions 34. Specifically, the connector terminal portions 36 are shaped to be respectively fittable to a plurality of connector terminals included in a mating connector CC, which is a connector provided at an end of a wire bundle different from the plurality of wires 10 and shown by chain double-dashed line in FIGS. 1 and 2.

The insulating housing HG in this joint connector includes a terminal holding housing portion 40 for holding the respective wire-side terminals 20 and a shorting member holding housing portion 50, which is a member independent of the terminal holding housing portion 40, for holding the shorting members 30.

The terminal holding housing portion 40 is molded from an insulating material such as synthetic resin and includes a terminal holding portion 43, a casing portion 44, a receptacle 46 and a retainer 47. Out of these, the terminal holding portion 43, the casing portion 44 and the receptacle 46 are integrally molded as a housing portion body, which is a single member, and the retainer 47 is mounted into the housing portion body as a member separate from the housing portion body.

The terminal holding portion 43 defines terminal accommodating chambers 41 and includes locking lances 42 in the respective terminal accommodating chambers 41.

Each terminal accommodating chamber 41 is shaped to receive each of the plurality of wire-side terminals 20 inserted therein along an axial direction of the wire-side terminal 20. Specifically, the terminal accommodating chambers 41 are formed to be arranged in vertical and horizontal directions, i.e. laterally arranged in a plurality of stages, and each terminal accommodating chamber 41 includes a terminal insertion opening 41*a* open on one side (right side in FIGS. 1 and 2) in the axial direction. Each wire-side terminal 20 can be inserted into the corresponding terminal accommodating chamber 41 through the terminal insertion opening 41*a* with the electrical contact portion 24 in the lead.

Figure 4:
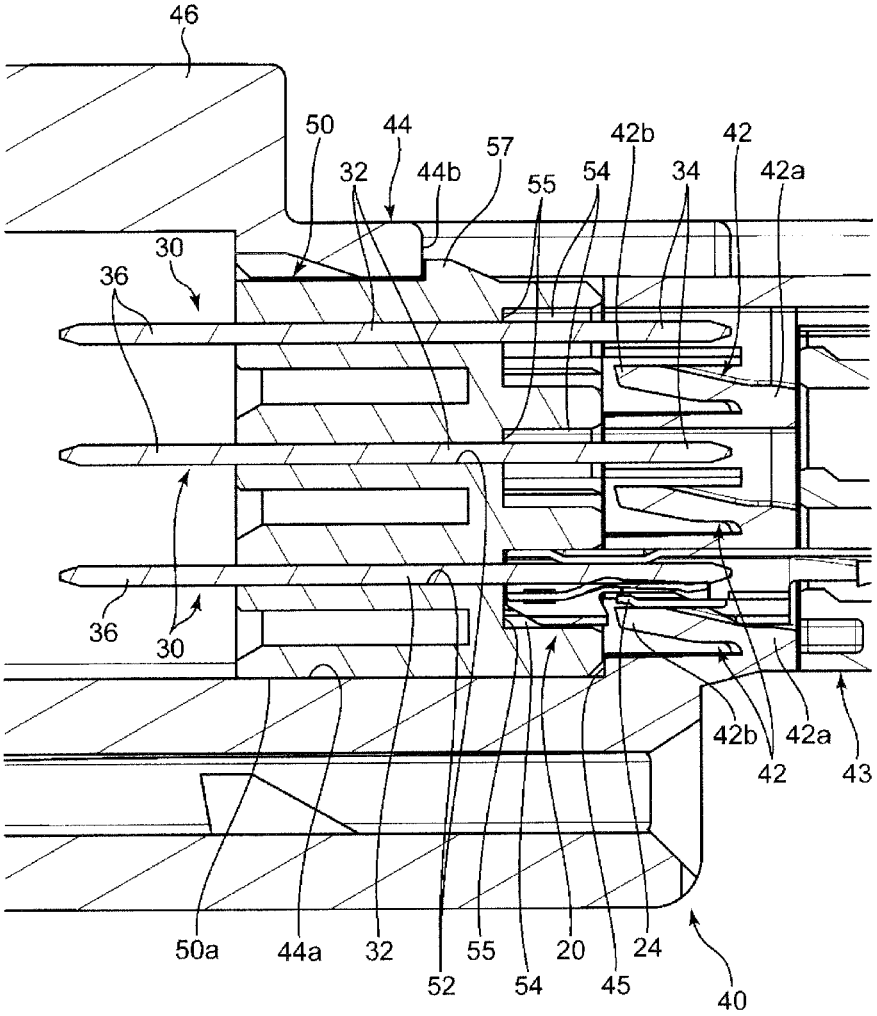
FIG. 4 is a side view in section enlargedly showing an essential part of the joint connector shown in FIG. 1.
Figure 5:
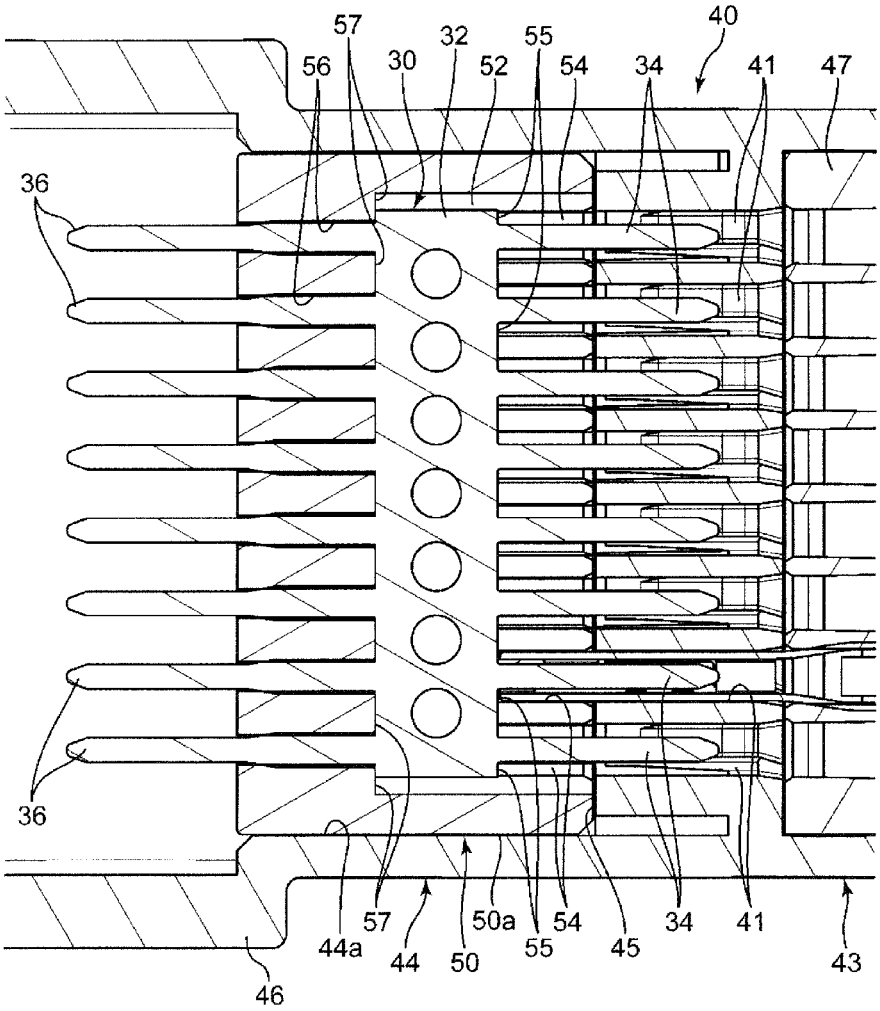
FIG. 5 is a plan view in section enlargedly showing an essential part of the joint connector shown in FIG. 2.
Figure 6:
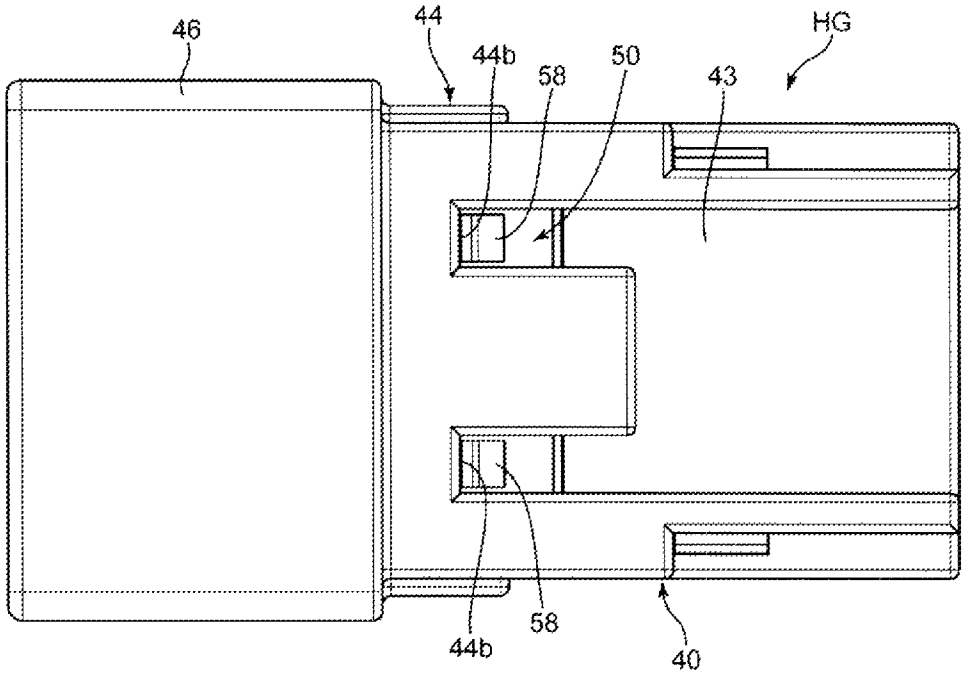
FIG. 6 is a plan view of the joint connector.
Figure 7:
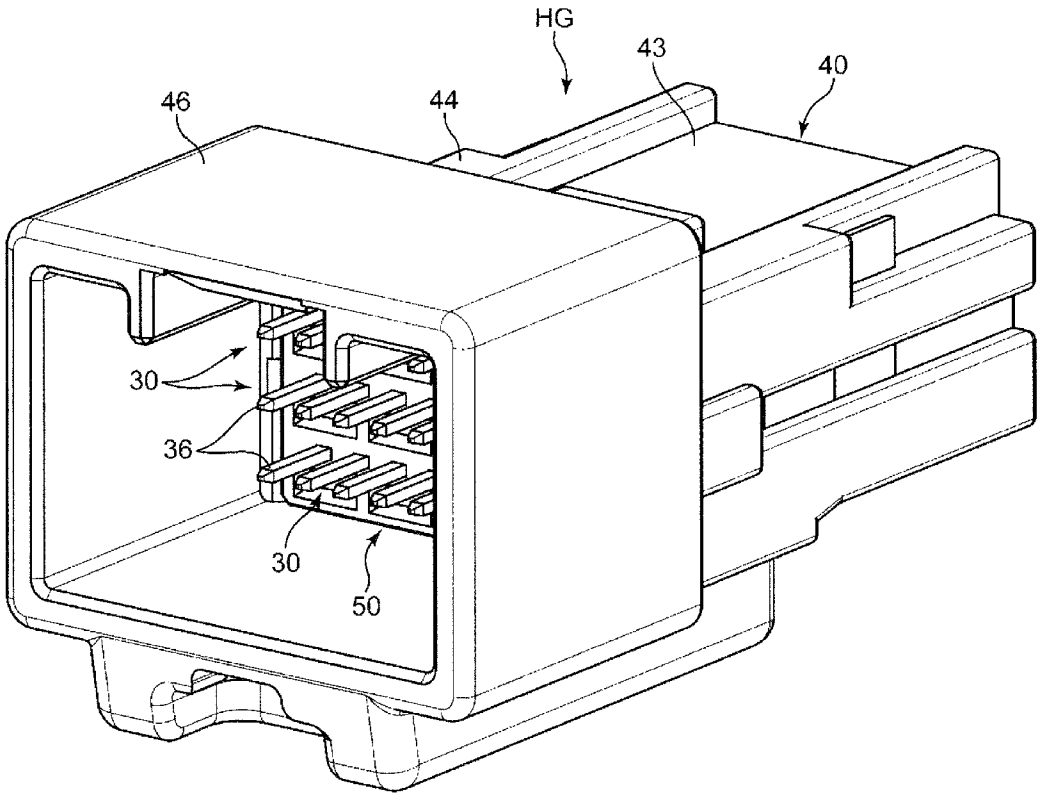
FIG. 7 is a perspective view of the joint connector viewed from the side of a receptacle.

Each of the locking lances 24 constitutes a terminal locking portion for locking (primarily locking) the wire-side terminal 20 inserted into the terminal accommodating chamber 41. The locking lance 42 is in the form of a cantilever. Specifically, as shown in FIGS. 4 and 5, the locking lance 42 includes a base portion 42*a* connected to a part of a wall defining the terminal accommodating chamber 41 and a tip portion 42*b*, which is an end part opposite to the base portion 42*a*, and can be resiliently deformed such that the tip portion 42*b* is deflected and displaced in a direction (downward direction in FIG. 1) perpendicular to the axial direction of the wire-side terminal 20. The locking lance 42 allows the wire-side terminal 20 to be inserted into the terminal accommodating chamber 41 by the tip portion 42*b* being deflected and displaced in a direction to be retracted from the wire-side terminal 20 (upward direction in FIG. 1), whereas the locking lance 42 locks (primarily locks) the wire-side terminal 20 in the terminal accommodating chamber 41 by partially resiliently returning with the wire-side terminal 20 completely inserted in the terminal accommodating chamber 41. Specifically, the tip portion 42*b* of the locking lance 42 engages an appropriate part (intermediate part of the electrical contact portion 24 in an example of FIGS. 4 and 5) of the inserted wire-side terminal 20 to impede the detachment of the wire-side terminal 20.

The retainer 47 is mounted into the terminal holding portion 43 in the housing portion body to lock (secondarily lock) the wire-side terminals 20 inserted into the respective terminal accommodating chambers 41 in the terminal holding portion 43 separately from locking by the locking lances 42. Specifically, the retainer 47 is shaped to define windows 47*a* constituting specific parts of the respective terminal accommodating chambers 41 behind the respective locking lances 42 and includes locking projections 47*b* for locking specific parts of the wire-side terminals 20 (rear ends of the wire crimping portions 22 in FIG. 1) inserted into the respective terminal accommodating chambers 41. The retainer 47 is movable between a locking position shown in FIGS. 1 and 4 where the locking projections 47*b* lock the wire-side terminals 20 and a retracted position shifted from the locking position in a direction (downward direction in FIG. 1) perpendicular to the axial direction of the wire-side terminals 20. At the retracted position, the windows 47*a* match the other parts of the terminal accommodating chambers 41, thereby allowing the wire-side terminals 20 to be inserted into the terminal accommodating chambers 41 through the windows 47*a* of the retainer 47.

This retainer 47 can be omitted as appropriate in the present invention.

The casing 44 is a part adjacent to the terminal holding portion 43 on a side (left side in FIGS. 1 and 2) opposite to the respective terminal insertion openings 41*a* and configured to accommodate the shorting member holding housing portion 50 while relatively displaceably holding the shorting member holding housing portion 50. Further, the receptacle 46 is a part extending from the casing portion 44 toward a side (left side in FIGS. 1 and 2) opposite to the terminal holding portion 43. The casing 44 and receptacle 46 are described in detail later.

The shorting member holding housing portion 50 is formed of an insulating material such as synthetic resin as a member separate from the terminal holding housing portion 40, and has a substantially rectangular parallelepiped shape in this embodiment. The shorting member holding housing portion 50 holds each of the plurality of shorting members 30. Specifically, the shorting member holding housing portion 50 holds the shorting members 30 such that the shorting members 30 are arranged in a plurality of stages at a position separated from the terminal holding housing portion 40 and penetrate through the shorting member holding housing portion 50 in a direction parallel to the axial direction of the wire-side terminals 20.

This shorting member holding housing portion 50 is accommodated and held in the casing 44 of the terminal holding housing portion 40. This shorting member holding housing portion 50 is held at such a position that the terminal fitting portions 34 of the respective shorting members 30 project into the respective terminal accommodating chambers 41 from a side (left side in FIGS. 1 and 2) opposite to the terminal insertion openings 41*a* and the electrical contact portions 24 of the wire-side terminals 20 inserted in the respective terminal accommodating chambers 41 can be fit to the terminal fitting portions 34 (specifically, the terminal fitting portions 34 are fit into the electrical contact portions 24).

The shorting member holding housing portion 50 includes base portion press-fit portions 52 configured to receive the base portion 32 of each shorting member 30 press-fit thereinto, a plurality of terminal insertion holes 56 communicating with the base portion press-fit portions 52 and configured to receive the respective connector terminal portions 36 inserted therethrough and a plurality of terminal fitting portions 54 located on a side opposite to the terminal insertion holes 56 across the base portion press-fit portions 52. The terminal fitting portion 54 is shaped to allow the base portion 32 to be press-fit into the base portion press-fit portion 52 therethrough and allow the electrical contact portion 24 of the wire-side terminal 20 to be fit to each terminal fitting portion 34 to be fit into the terminal fitting portion 54. The terminal fitting portion 54 according to this embodiment is a recess having a bottom portion 55, and this bottom portion 55 functions as a contact portion for specifying the position of the tip of the electrical contact portion 24 by coming into contact with the tip of the electrical contact portion 24 being fit into the terminal fitting portion 54.

The casing 44 accommodates and holds the shorting member holding housing portion 50 in such a manner as to allow a relative displacement of the shorting member holding housing portion 50 with respect to the terminal holding housing portion 40 including this casing 44, particularly a relative displacement in a direction perpendicular to the axial direction of each wire-side terminal 20 within a limited range. Specifically, this casing 44 has an inner peripheral surface 44*a* shaped to embrace the shorting member holding housing portion 50 with a small clearance formed between the inner peripheral surface 44*a* and an outer peripheral surface 50*a* of the shorting member holding housing portion 50, and is open toward a side opposite to each terminal accommodating chamber 41. The clearance enables the shorting member holding housing portion 50 to be displaced with respect to the casing 44 in the direction perpendicular to the axial direction of the wire-side terminals 20 within a range corresponding to this clearance.

A step 45, as shown in FIGS. 4 and 5, is formed on a boundary between the casing portion 44 and the terminal holding portion 43, and this step 45 restrains an end of the shorting member holding housing portion 50 on the side of the terminal holding portion 43. On the other hand, the shorting member holding housing portion 50 includes a pair of restrained projections 58 projecting from the outer peripheral surface thereof, and the casing 44 has a restraining surface 44*b* for restraining the shorting member holding housing portion 50 from a side opposite to the step 45 by contacting the restrained projections 58.

That is, the casing 44 restrains the shorting member holding housing portion 50 to sandwich the shorting member holding housing portion 50 between the step 45 and the restraining surface 44*b* and holds and accommodates the shorting member holding housing portion 50 to allow a relative displacement of the shorting member holding housing portion 50 with respect to the casing 44, particularly a relative displacement in the direction perpendicular to the axial direction of the wire-side terminals 20 by an amount corresponding to the above clearance (clearance between the outer peripheral surface 50*a* of the shorting member holding housing portion 50 and the inner peripheral surface 44*a* of the casing 44).

The receptacle 46 is shaped to surround the respective connector terminal portions 36 projecting from the shorting member holding housing portion 50 and receive a housing of the inserted mating connector CC inserted thereinto. As just described, the receptacle 46 constitutes, together with the respective connector terminal portions 36, a joint connector part connectable to the mating connector CC.

In the joint connector described above, the both housing portions 40, 50 are so connected as to enable a relative displacement of the shorting member holding housing portion 50 holding the shorting members 30 with respect to the terminal holding housing portion 40 for locking the respective wire-side terminals 20 within the limited range. Thus, unlike conventional joint connectors in which the entire insulating housing is integrally molded, the shorting members 30 to be fit to the wire-side terminals 20 can be displaced together with the shorting member holding housing portion 50 within a limited range, following small displacements of the wire-side terminals 20 in the terminal holding housing portion 40, while a force for holding the shorting members 30 by the shorting member holding housing portion 50 is strengthened. This enables relative displacements of the wire-side terminals 20 and the shorting members 30 to be suppressed and the abrasion of contact parts between the both due to these relative displacements to be suppressed.

Particularly, in this embodiment, the wire-side terminals 20 are held in the terminal holding housing portion 40 by the locking lances 42 resiliently deflectable and deformable in the direction perpendicular to the axial direction of the wire-side terminals 20, and this locking easily allows relative displacements of the wire-side terminals 20 with respect to the terminal holding housing portions 40. Thus, it is a big advantage that the shorting member holding housing portion 50 is relatively displaceable together with the shorting members 30 with respect to the terminal holding housing portion 40.

Further, since the shorting member holding housing portion 50 includes the terminal fitting portions 54 for receiving the fit electrical contact portions 24 of the wire-side terminals 20 to be fit to the terminal fitting portions 34 of the shorting members 30, a displacement of the shorting member holding housing portion 50 following displacements of the wire-side terminals 20 can be promoted by this fitting.

Further, the terminal fitting portion 54 is a recess having the bottom portion 55 and this bottom portion 55 functions as the contact portion for specifying the position of the tip of the wire-side terminal 20 by coming into contact with the tip of the electrical contact portion 24 being fit into the terminal fitting portion 54. Thus, the terminal fitting portion 54 has both a function of promoting the displacement of the shorting member holding housing portion 50 following the displacement of the wire-side terminal 20 and a function of specifying the tip position of the wire-side terminal 20.

Further, the shorting member holding housing portion 50 includes step portions 57 on a boundary between the base portion press-fit portions 52 and the respective terminal insertion holes 56, and these step portions 57 butt against the base portions 32 of the shorting members 30 in a direction (rightward direction in FIG. 2) opposite to an inserting direction of the wire-side terminals 20. Thus, the shorting member holding housing portion 50 can restrain the shorting members 30 against insertion forces of the wire-side terminals 20 while receiving the shorting members 30 press-fit thereinto. This effect is obtained by forming the terminal holding housing portion 40 and the shorting member holding housing portion 50 as separate members.

Figure 8:
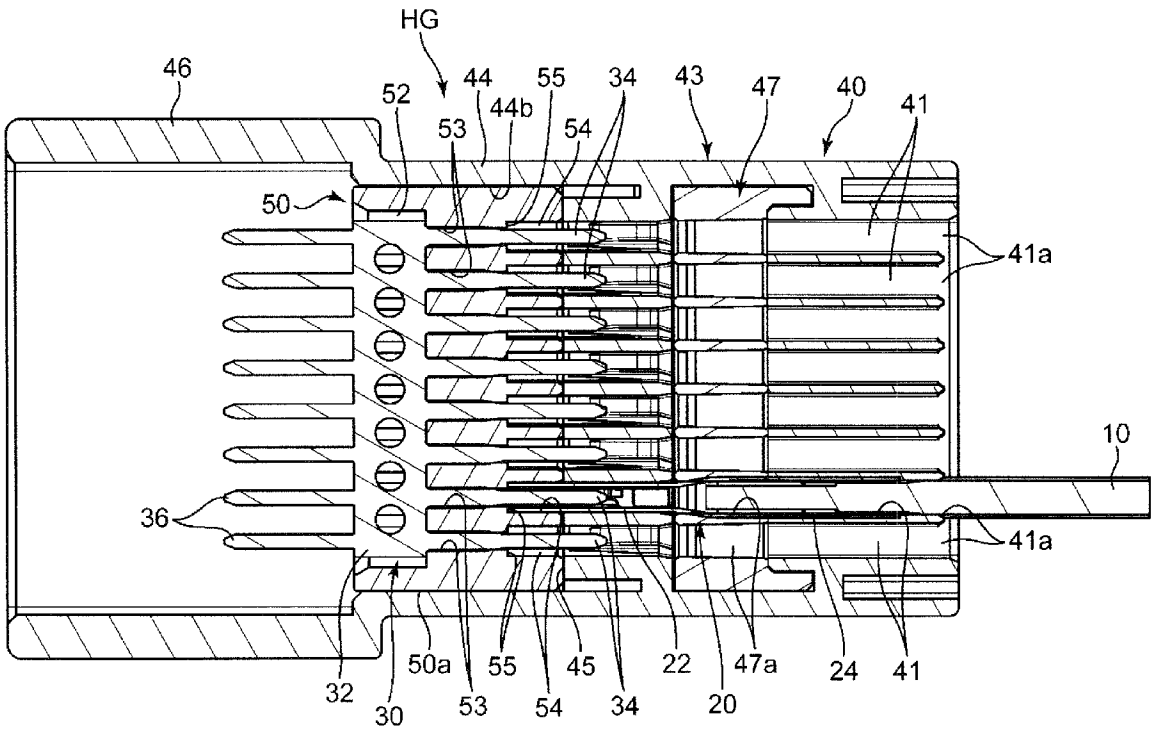
FIG. 8 is a plan view in section, corresponding to FIG. 2, showing a modification of a shorting member holding housing portion in the joint connector.
Figure 9:
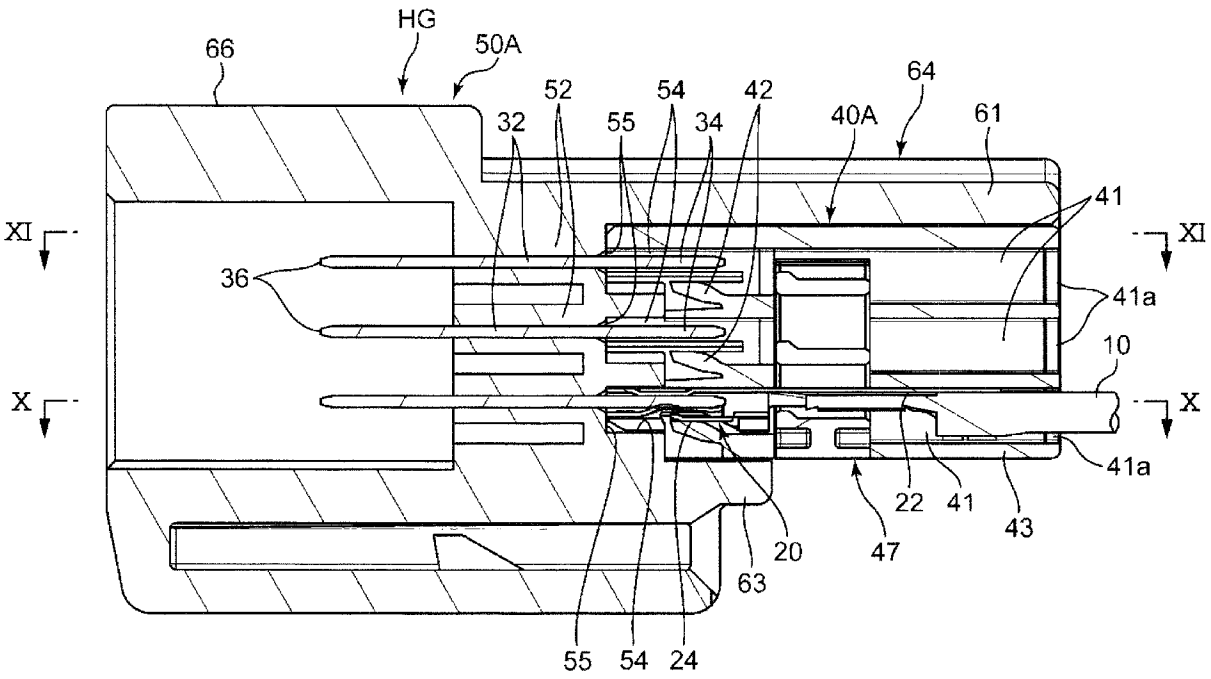
FIG. 9 is a side view in section along IX-IX of FIG. 12 of a joint connector according to a second embodiment of the present invention.
Figure 10:
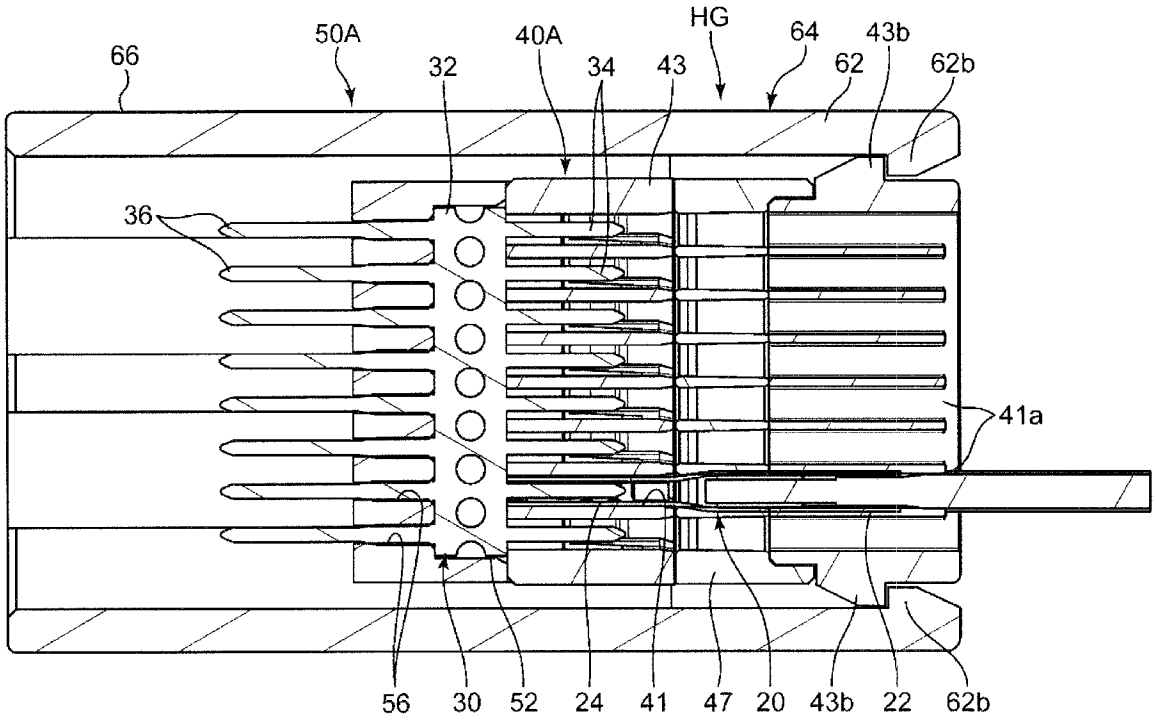
FIG. 10 is a plan view in section along X-X of FIG. 9.

However, a press-fitting direction of the shorting members 30 into the shorting member holding housing portion 50 is not limited to this and may be an opposite direction. For example, as shown in FIG. 8, the base portion press-fit portions 52 and a plurality of terminal fitting portion insertion holes 53 may be open on the side of the receptacle 46 and the base portions 32 and the plurality of terminal fitting portions 34 of the shorting members 30 may be respectively inserted into the base portion press-fit portions 52 and the terminal fitting portion insertion holes 53 from the side of the receptacle 46 (left side in FIG. 2).

Further, since the terminal holding housing portion 40 and the shorting member holding housing portion 50 are separate members, materials constituting the both holding housing portions 40, 50 can be made different from each other. For example, by molding the terminal holding housing portion 40 from a first material having a first elastic modulus enabling sufficient deflection and deformation of the locking lances 42 (e.g. resin such as PBT or polyamide) and molding the shorting member holding housing portion 50 from a second material having a second elastic modulus larger than the first elastic modulus (e.g. resin such as glass fiber containing PBT, LCP or SPS), it is possible both to guarantee sufficient deflection and deformation of each locking lance 42 in the terminal holding housing portion 40 and to ensure a sufficient force to hold the shorting members 30 by the shorting member holding housing portion 50.

A second embodiment of the invention is shown in FIGS. 9 to 13. The terminal holding housing portion 40 is formed with the casing 44 for accommodating the shorting member holding housing portion 50 and the receptacle 46 integrally connected to the casing 44 in the first embodiment, whereas a shorting member holding housing portion 50A is formed with a casing 64 for accommodating a terminal holding housing portion 40A and a receptacle 66 integrally connected to the casing 64 in the second embodiment.

Specifically, the terminal holding housing portion 40A of this second embodiment includes a terminal holding portion 43 defining a plurality of terminal accommodating chambers 41 and a retainer 47 to be mounted into the terminal holding portion 43 similarly to the terminal holding housing portion 40 according to the first embodiment, but does not include the casing portion 44 and the receptacle 46 according to the first embodiment. On the other hand, the shorting member holding housing portion 50A according to the second embodiment includes the casing 64 and the receptacle 66 in addition to base portion press-fit portions 52 and terminal insertion holes 56 similar to the shorting member holding housing portion 50 according to the first embodiment.

The casing 64 includes a ceiling wall 61 covering the terminal holding housing portion 40A from above, a pair of left and right side walls 62 covering from the left and right sides and a bottom wall 63 covering from below. Out of these, the bottom wall 63 has a smaller dimension than the ceiling wall 61 and the pair of side walls 62 in an axial direction of wire-side terminals 20, and causes the retainer 47 mounted into the terminal holding portion 43 to be exposed downward. As just described, a "casing" mentioned in the present invention is not necessarily limited to the one entirely covering a mating housing portion, and may expose a part of the mating housing portion according to the structure thereof.

Figure 11:
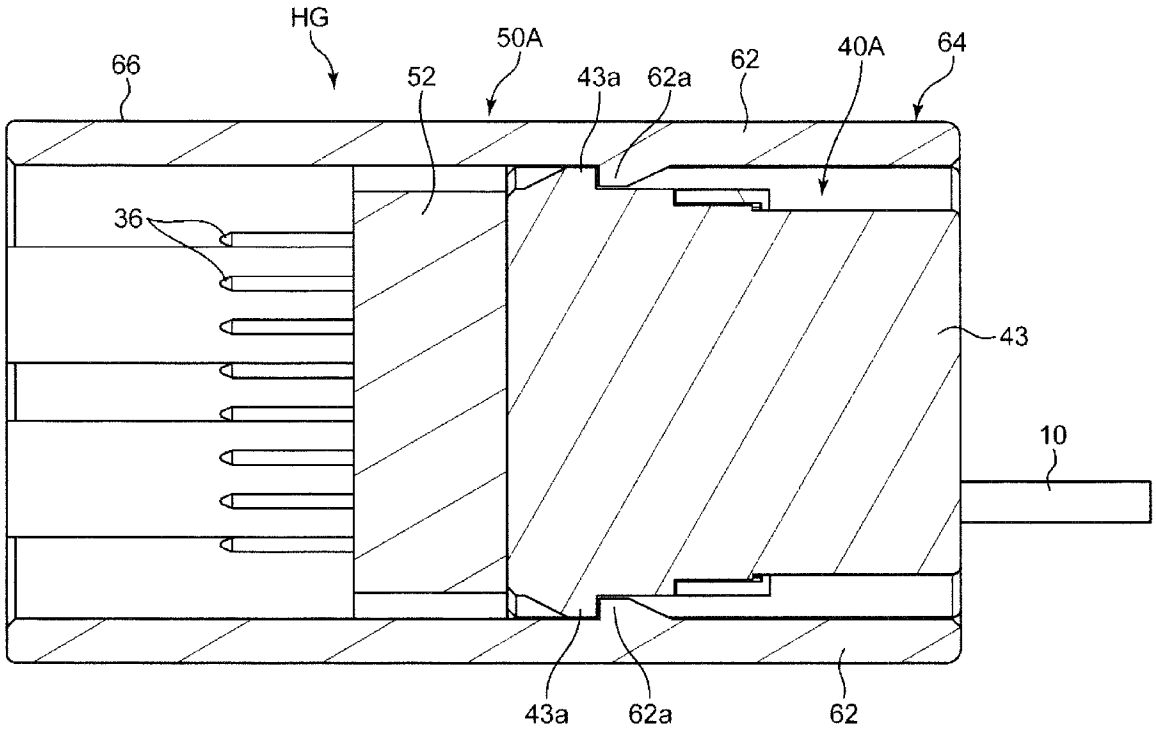
FIG. 11 is a plan view in section along XI-XI of FIG. 9.
Figure 12:
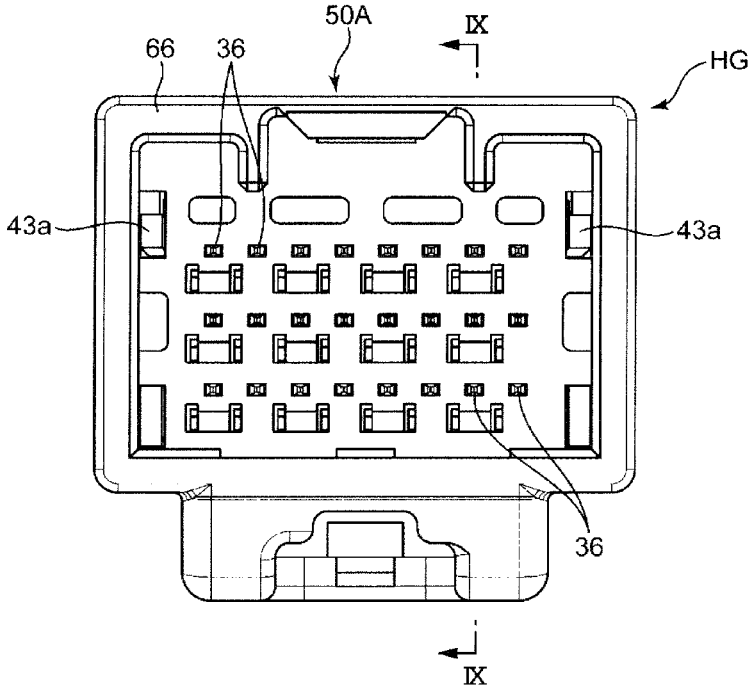
FIG. 12 is a back view of the joint connector shown in FIG. 9.
Figure 13:
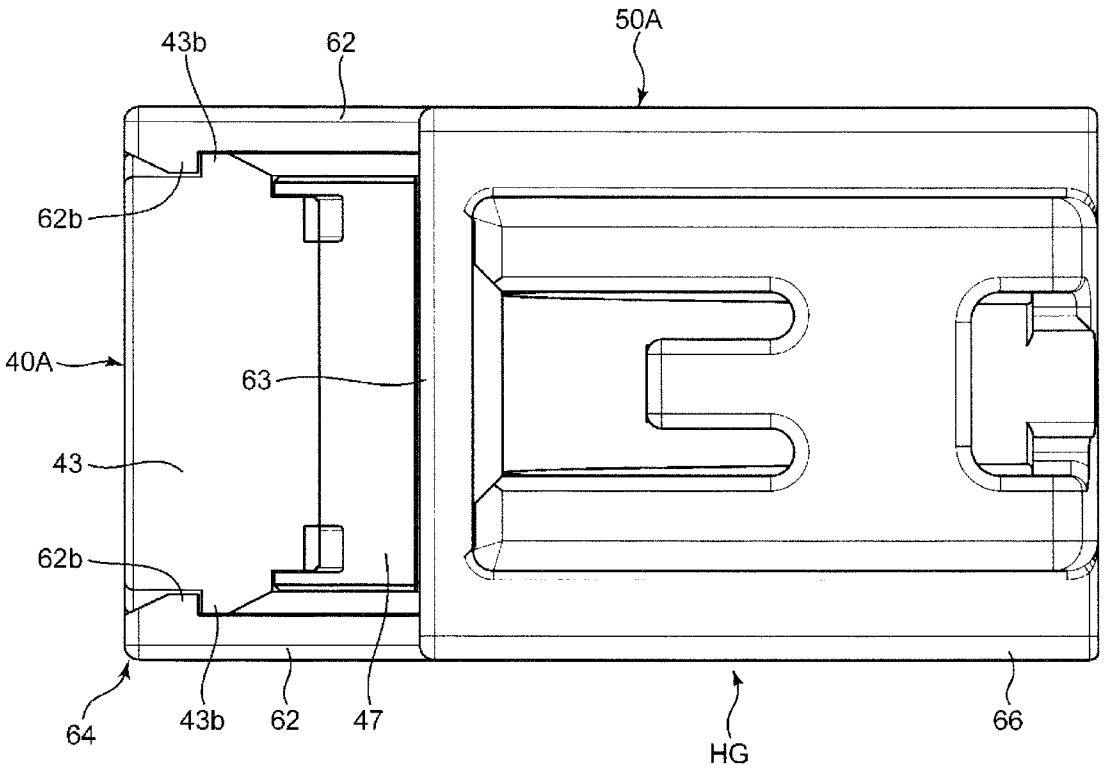
FIG. 13 is a bottom view of the joint connector shown in FIG. 9.

The terminal holding housing portion 40A is restrained from both sides in the axial direction of the wire-side terminals 20 by the casing 64. Specifically, the terminal holding portion 43 of the terminal holding housing portion 40A includes a pair of restrained projections 43*a* projecting toward both outer left and right sides on the front end (left end in FIG. 11) as shown in FIG. 11 and a pair of restrained projections 43*b* projecting toward both outer left and right sides on an intermediate part in a front-rear direction as shown in FIG. 13. In contrast, the base portion press-fit portions 52 of the shorting member holding housing portion 50A restrain the terminal holding housing portion 40A from front (left side in FIGS. 9 and 10) and restraining projections 62*a*, 62*b* formed to project inward on the pair of side walls 62 restrain the restrained projections 43*a*, 43*b* from behind.

Also in this second embodiment, similarly to the first embodiment, an appropriate clearance is given between the outer peripheral surface of the terminal holding housing portion 40A and the inner peripheral surface of the casing portion 64 to allow a relative displacement of the terminal holding housing portion 40A with respect to the casing portion 63, particularly a relative displacement in a direction perpendicular to the axial direction of the wire-side terminals 20 within a limited range, whereby the shorting members 30 are allowed to be displaced together with the wire-side terminals 20 while the shorting members 30 are firmly held by the shorting member holding housing portion 50. Thus, the relative displacements of the both can be suppressed. In this way, the abrasion of contact parts due to these relative displacements can be effectively suppressed.

However, in the present invention, the casing 44, 64 and the receptacle 46, 66 are not essential and may be omitted as appropriate. For example, a shorting member according to the present invention may include only a base portion and a plurality of terminal fitting portions without including connector terminal portions. In this case, the receptacle is not necessary. Further, in the present invention, the casing portion may be omitted and the terminal holding housing portion and the shorting member holding housing portion may be coupled to each other in a fifty-fifty relationship, i.e. the both housing portions may be relatively displaceably coupled to each other via a suitable coupling portion instead of one of the housing portions accommodating the other.

As described above, a joint connector is provided which includes wire-side terminals to be mounted respectively on wires and a shorting member configured to contact these wire-side terminals and can suppress the abrasion of contact parts due to relative displacements between the wire-side terminals and the shorting member.

A joint connector for forming a short circuit for shorting a plurality of wires is provided, and includes wire-side terminals to be mounted on ends of the respective wires, a shorting member formed of a conductor and including a base portion extending in a specific direction and terminal fitting portions projecting in the same direction from the base portion, each terminal fitting portion being shaped to be fit to each wire-side terminal, and an insulating housing defining terminal accommodating chambers enabling the wire-side terminals to be inserted therein along an axial direction of the wire-side terminals and configured to hold the shorting member such that the wire-side terminal inserted into each terminal accommodating chamber is fit to the terminal fitting portion. The insulating housing includes a terminal holding housing portion defining the terminal accommodating chambers and including terminal locking portions configured to lock the respective wire-side terminals inserted into the terminal accommodating chambers, and a shorting member holding housing portion, which is a member independent of the terminal holding housing portion, configured to hold the shorting member at a position where the shorting member is spaced from the terminal holding housing portion, and the terminal holding housing portion and the shorting member holding housing portion are so connected while restraining each other as to allow a relative displacement of the shorting member holding housing portion with respect to the terminal holding housing portion within a limited range.

In this joint connector, the housing portions are so connected in the insulating housing as to make the shorting member holding housing portion holding the shorting member relatively displaceable within the limited range with respect to the terminal holding housing portion for accommodating and locking the wire-side terminals. Thus, unlike conventional joint connectors in which the entire insulating housing is integrally molded, the shorting member to be fit to the wire-side terminals can be displaced within the limited range together with the shorting member holding housing portion, following small displacements of the wire-side terminals in the terminal holding housing portion while a force for holding the shorting member by the shorting member holding housing portion is strengthened. This enables relative displacements of the wire-side terminals and the shorting member to be suppressed and the abrasion of contact parts between the both due to these relative displacements to be suppressed.

Particularly, if each terminal locking portion of the terminal holding housing portion is a locking lance resiliently delectable and deformable in a direction perpendicular to the axial direction of the wire-side terminals, the wire-side terminal is easily relatively displaced with respect to the terminal holding housing portion, wherefore it is very effective that the shorting member holding housing portion is relatively displaceable with respect to the terminal holding housing portion.

In this joint connector, the shorting member holding housing portion preferably includes a contact portion configured to specify tip positions of the wire-side terminals by coming into contact with the wire-side terminals being fit to the terminal fitting portions of the shorting member. In this way, excessive insertion of the wire-side terminals into the terminal accommodating chambers is prevented by a rational structure utilizing the shorting member holding housing portion.

Further, the shorting member holding housing portion preferably includes terminal fitting portions configured to receive fit tip portions of the wire-side terminals to be fit to the terminal fitting portions of the shorting member. This fitting of the tip portions of the wire-side terminals into the terminal fitting portions promotes a displacement of the shorting member holding housing portion, following displacements of the wire-side terminals.

In this case, more preferably, the terminal fitting portion is a recess having a bottom portion and this bottom portion constitutes the contact portion configured to specify the tip position of the wire-side terminal by coming into contact with the tip of the wire-side terminal being fit into the terminal fitting portion. In this way, the terminal fitting portion is provided with both a function of promoting a displacement of the shorting member holding housing portion, following a displacement of the wire-side terminal and a function of specifying the tip position of the wire-side terminal.

The shorting member holding housing portion preferably includes a shorting member inserting portion open toward the terminal accommodating chambers and configured to hold the shorting member by receiving the shorting member inserted thereinto in the same direction as an inserting direction of the wire-side terminals, and a shorting member restraining portion configured to restrain the shorting member by butting against the shorting member inserted into the shorting member inserting portion in a direction opposite to the inserting direction of the shorting member. This structure enables the shorting member holding housing portion to be reliably held against insertion forces of the wire-side terminals while enabling the shorting member to be set in the shorting member holding housing portion by a simple operation of inserting the shorting member into the shorting member inserting portion.

If each terminal locking portion of the terminal holding housing portion is a locking lance resiliently deformable and deflectable in a direction perpendicular to the axial direction of the wire-side terminals, the terminal holding housing portion is preferably molded from a first material having a first elastic modulus enabling the deflection and deformation and the shorting member holding housing portion is preferably molded from a second material having a second elastic modulus larger than the first elastic modulus. This makes it possible both to guarantee sufficient deflection and deformation of the locking lances constituting the terminal locking portions in the terminal holding housing portion and to ensure a sufficient force to hold the shorting member by the shorting member holding housing portion, utilizing a structure in which the terminal holding housing portion and the shorting member holding housing portion are separate members.

A specific connection mode of the terminal holding housing portion and the shorting member holding housing portion is, for example, preferably such that either one of the terminal holding housing portion and the shorting member holding housing portion is a housing portion with case integrally including a casing portion configured to accommodate the other housing portion while holding the other housing portion in such a manner as to allow a relative displacement of the other housing portion within a limited range.

The shorting member may include, in addition to the terminal fitting portions, a plurality of connector terminal portions projecting from the base portion toward a side opposite to the terminal fitting portions and respectively fittable to a plurality of connector terminals included in a mating connector. In this case, more preferably, the housing portion with case further includes a receptacle extending from the casing portion and configured to cover the plurality of connector terminal portions from outside. This enables a novel joint connector with the plurality of connector terminal portions and the receptacle to be constructed by a rational structure utilizing the shorting member including the terminal fitting portions and the housing portion with case including the casing portion.

The invention claimed is:

1. A joint electrical connector for forming a short circuit for shorting a plurality of wires, comprising:

wire-side terminals to be mounted on ends of the respective wires;

a plurality of shorting members each formed of a conductor and including a base extending in a specific direction and terminal fitting portions projecting in the same direction from the base, each terminal fitting portion being shaped to fit to each wire-side terminal; and an insulating housing including a terminal holding housing portion, the terminal holding housing portion having a terminal holding portion including terminal accommodating chambers formed with terminal locking portions, the wire-side terminals inserted therein along an axial direction of the wire-side terminals and locked therein by the terminal locking portions, a casing extending from the terminal holding portion and having a cavity, a shorting member holding housing portion accommodated in the cavity with clearances formed between an outer surface of the shorting member and an inner peripheral surface of the cavity, the shorting member holding housing portion configured to hold the shorting member such that the wire-side terminal inserted into each terminal accommodating chamber is fit to the terminal fitting portion, the short member holding housing portion holding the shorting member at a position spaced from the terminal holding housing portion, and the shorting member holding housing portion being displaceable with respect to the terminal holding housing portion in a direction normal to the axial direction of the wire side terminals.

2. The joint electrical connector of claim 1, wherein the shorting member holding housing portion includes a contact portion configured to specify tip positions of the wire-side terminals by coming into contact with the wire-side terminals being fit to the terminal fitting portions of the shorting member.

3. The joint electrical connector of claim 1, wherein the shorting member holding housing portion includes terminal fitting portions configured to receive fit tip portions of the wire-side terminals to be fit to the terminal fitting portions of the shorting member.

4. The joint electrical connector of claim 3, wherein the terminal fitting portion is a recess having a bottom portion and the bottom portion constitutes the contact portion configured to specify the tip position of the wire-side terminal by coming into contact with the tip of the wire-side terminal being fit to the terminal fitting portion.

5. The joint electrical connector of claim 4, wherein the shorting member holding housing portion includes a shorting member inserting portion open toward the terminal accommodating chambers and configured to hold the shorting member by receiving the shorting member inserted thereinto in the same direction as an inserting direction of the wire-side terminal, and a shorting member restraining portion configured to restrain the shorting member by butting against the shorting member inserted into the shorting member inserting portion in a direction opposite to the inserting direction of the shorting member.

6. The joint electrical connector of claim 5, wherein each terminal locking portion of the terminal holding housing portion is a locking lance resiliently deflectable and deformable in a direction perpendicular to an axial direction of the wire-side terminals.

7. The joint electrical connector of claim 6, wherein the terminal holding housing portion is molded from a first material having a first elastic modulus enabling the deflection and deformation and the shorting member holding housing portion is molded from a second material having a second elastic modulus larger than the first elastic modulus.

8. The joint electrical connector of claim 7, wherein either one of the terminal holding housing portion and the shorting member holding housing portion is a housing portion with case integrally including a casing portion configured to accommodate the other housing portion while holding the other housing portion in such a manner as to allow a relative displacement of the other housing portion within a limited range.

9. The joint electrical connector of claim 8, wherein the shorting member includes, in addition to the terminal fitting portion, a plurality of connector terminal portions projecting from the base portion toward a side opposite to the terminal fitting portions and respectively fittable to a plurality of connector terminals included in a mating connectors, and the housing portion with case further includes a receptacle extending from the casing portion and configured to cover the plurality of connector terminal portions from outside.

10. The joint electrical connector of claim 1, wherein the shorting member holding housing portion includes a shorting member inserting portion open toward the terminal accommodating chambers and configured to hold the shorting member by receiving the shorting member inserted thereinto in the same direction as an inserting direction of the wire-side terminal, and a shorting member restraining portion configured to restrain the shorting member by butting against the shorting member inserted into the shorting member inserting portion in a direction opposite to the inserting direction of the shorting member.

11. The joint electrical connector of claim 1, wherein each terminal locking portion of the terminal holding housing portion is a locking lance resiliently deflectable and deformable in a direction perpendicular to an axial direction of the wire-side terminals.

12. The joint electrical connector of claim 11, wherein the terminal holding housing portion is molded from a first material having a first elastic modulus enabling the deflection and deformation and the shorting member holding housing portion is molded from a second material having a second elastic modulus larger than the first elastic modulus.

13. The joint electrical connector of claim 1, wherein either one of the terminal holding housing portion and the shorting member holding housing portion is a housing portion with case integrally including a casing portion configured to accommodate the other housing portion while holding the other housing portion in such a manner as to allow a relative displacement of the other housing portion within a limited range.

14. The joint electrical connector of claim 13, wherein the shorting member includes, in addition to the terminal fitting portion, a plurality of connector terminal portions projecting from the base portion toward a side opposite to the terminal fitting portions and respectively fittable to a plurality of connector terminals included in a mating connectors, and the housing portion with case further includes a receptacle extending from the casing portion and configured to cover the plurality of connector terminal portions from outside.

15. A joint electrical connector for forming a short circuit for shorting a plurality of wires, comprising:

wire-side terminals to be mounted on ends of the respective wires;

a plurality of shorting members each formed of a conductor and including a base extending in a specific direction and terminal fitting portions projecting in the same direction from the base, each terminal fitting portion being shaped to fit to each wire-side terminal; and an insulating housing including:

a terminal holding housing portion having terminal accommodating chambers formed with terminal locking portions, the wire-side terminals inserted therein along an axial direction of the wire-side terminals and locked therein by the terminal locking portions, a casing extending from the terminal holding housing portion and having a cavity; and a shorting member holding housing portion accommodated in the cavity with clearances formed between an outer surface of the shorting member and an inner peripheral surface of the cavity, a shorting member inserting portion open toward the terminal accommodating chambers and configured to hold the shorting member by receiving the shorting member inserted in the same direction as an inserting direction of the wire-side terminal such that the wire-side terminal inserted into each terminal accommodating chamber is fit to the terminal fitting portion and the shorting member being held at a position spaced from the terminal holding housing portion, and a shorting member restraining portion configured to restrain the shorting member by butting against the shorting member inserted into the shorting member inserting portion in a direction opposite to the inserting direction of the shorting member, wherein the shorting member holding housing portion is displaceable within the cavity with respect to the terminal holding housing portion in a direction normal to the axial direction of the wire side terminals.

* * * * *